US006189630B1

(12) United States Patent
Beck, III

(10) Patent No.: US 6,189,630 B1
(45) Date of Patent: Feb. 20, 2001

(54) DOWNHOLE HAMMER-TYPE CORE BARREL

(76) Inventor: August H. Beck, III, 10 Hearthwood, San Antonio, TX (US) 78248

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/098,940

(22) Filed: Jun. 17, 1998

(51) Int. Cl.[7] ..... E21B 4/16
(52) U.S. Cl. ..... 175/96; 175/108; 175/405
(58) Field of Search ..... 175/96, 108, 405, 175/415; 405/253

(56) References Cited

U.S. PATENT DOCUMENTS

| | | | | |
|---|---|---|---|---|
| 2,016,068 | * | 10/1935 | Bannister | 175/96 |
| 4,013,319 | * | 3/1977 | Wise | 299/31 |
| 4,671,367 | * | 6/1987 | Brunsing et al. | 175/58 |
| 4,697,649 | * | 10/1987 | Kinnan | 175/19 |
| 4,729,439 | | 3/1988 | Kurt | 175/96 |
| 4,883,133 | * | 11/1989 | Fletcher et al. | 175/93 |
| 5,174,390 | * | 12/1992 | Kurt | 175/53 |

OTHER PUBLICATIONS

Informational Brochure on Keystone Drill Services Inc.
Informational brochure on The Hole Story—A Guide To Downhole Drills, Ingersoll–Rand Co., (Mar. 1997).

* cited by examiner

*Primary Examiner*—Hoang Dang
(74) *Attorney, Agent, or Firm*—Akin, Gump, Strauss, Hauer & Feld, LLP

(57) ABSTRACT

A core barrel has a plurality of pneumatic downhole hammer drills disposed around the perimeter of its working end for drilling piles in the ground for use in foundations, secant piles, and the like. The core barrel includes a slurry port and an air port at its top end for admitting a drilling slurry and pressurized air, which is used in driving the hammer drills and flushing cuttings from an annular kerf during drilling. A plurality of generally parallel plates form the top of the core barrel and define an air channel and a slurry channel for delivering air and slurry to the core barrel wall, where they flow freely or via conduits toward the hammer drills at the working end of the core barrel. The hammer-type core barrel is used to construct piles by first drilling an annular kerf in the ground. Circulating drilling fluid cools the working end of the hammer drills elements and washes cuttings from the kerf during drilling. The drilled core may be removed, or it may remain in situ, with the kerf being filled by cementitious material or by a structural steel casement.

10 Claims, 11 Drawing Sheets

DOWNHOLE HAMMER-TYPE CORE BARREL

FIELD OF THE INVENTION

The invention relates generally to techniques for drilling relatively large-diameter shafts for use as structural foundation piles, and more particularly to core barrels for constructing piling for buildings, bridges and the like.

BACKGROUND OF THE INVENTION

In the foundation drilling industry, it is desired to drill relatively large diameter shafts (on the order of 36 inches to 48 inches and up) in the earth, and these shafts are typically filled with reinforced concrete to form foundation piles for buildings, bridges, etc. Often a complete shaft is drilled, such as by auguring. Alternatively, in the so-called drill shaft construction technique, a large diameter, hollow core barrel is rotated so that cutters on its lower edge cut an annular kerf in the ground, which is typically rock or rocky ground. Once this kerf is drilled to the desired depth by the core barrel's cutting face, the rock core within the kerf may be broken up and augured out, or broken off and removed to permit the shaft to be filled with reinforced concrete for forming a pile. Alternatively, the core may be left in place, with the pile being formed by filling the annular kerf with cementitious material, steel casement, or other suitable means for forming the outermost portion of the pile. An example of the latter technique is disclosed in my U.S. application Ser. No. 08/780,097 filed Dec. 24, 1996, now U.S. Pat. No. 5,823, 276, the contents of which are incorporated herein by reference.

The use of sharp cutters to score the rock and form removable cuttings is but one way to drill shafts. In the prior art, there are also rotating, double-walled core barrels that have roller bits as the cutting surface. These roller bits are typically welded to the bottom of the barrel. As the core barrel rotates and the cutters scrape cuttings from the bottom of the kerf, pressurized air is circulated down between the double walls via a swivel through the rotary, thereby flushing cuttings up past the outer diameter of the core barrel and out of the kerf. The foregoing cutting techniques generally require extreme downward pressure on the core barrel.

For applications which only require smaller-diameter shafts, such as oil and gas drilling, it is known to use pneumatic, percussive-type downhole drills, which permit significant reductions in the amount of downward pressure that must be applied to the drilling apparatus. These small downhole "hammer" drills typically employ a drill bit with a circular cutting face having numerous protruding tungsten carbide buttons. A rotary head or kelly-bar drive causes the drill string to rotate in the shaft, and drilling pipes conduct compressed air to a piston (i.e., the hammer) near the end of the drill string, generating percussive blows of the cutting face of the drill bit to the earth at the bottom of the shaft. These percussive blows place the rock in compression, and the retreating drill bit places the rock in tension. This cyclic action, which may occur several hundred times per minute, breaks up the rock, which is then removed by a drilling fluid (often, simply air) which is circulated down into the shaft under pressure. Rotation of the drill string brings the drill bit into contact with fresh unbroken rock during successive percussion cycles.

Single downhole drills of the type described are typically from a few inches up to about 34 inches in diameter. Greater diameters are impractical due to the excessive cost of larger-diameter drill bits and large downhole hammers. To achieve larger-diameter shafts, it is known to use cluster drills comprising a plurality of hammer drills in a gang construction, as described in U.S. Pat. No. 4,729,439 to Kurt. In gang drills of this type, several hammer drills are arranged within a casing in a ring around a central hammer drill which is concentric with the casing and thus the shaft to be drilled. The cutting faces of the drill bits must be sufficiently large to cut swaths which completely cover the bottom of the shaft. For relatively large diameter shafts, e.g., 36 inches and greater, the number and size of hammer drills required makes their use impractical because air and fuel consumption tends to be quite high. In addition, noise levels for gang drills of this size (and large-diameter single downhole drills) may be intolerable, particularly if drilling is to occur near populated areas. Also, gang drills of this size suffer from disadvantages such as excessive weight and cost, and limited ability to be manhandled.

SUMMARY OF THE INVENTION

What is needed is a drilling apparatus which makes use of hammer-type drills and is suitable for drilling large-diameter shafts but does not suffer from the disadvantages of excessive air and fuel consumption, cost, weight and noise which accompany conventional gang drills and large-diameter single downhole drills.

Accordingly, an object of the present invention is to provide an improved hammer-type drill suitable for large-diameter applications having lower air and fuel consumption than conventional large-diameter gang drills.

Another object of the present invention is to provide an improved hammer-type drill suitable for large-diameter applications having lower cost and weight, and higher maneuverability, than conventional large-diameter gang drills and large-diameter single downhole drills.

Another object of the present invention is to provide an improved hammer-type drill suitable for large-diameter applications which does not require that drill bits cut a swath across the entire bottom of the shaft.

A further object of the present invention is to provide a core barrel for drilling foundation piles and the like without the use of cutters requiring large downward pressures on the barrel.

In satisfaction of these and other objects, the invention provides a hollow core barrel with a plurality of hammer drills disposed around its circumference at its working end. The core barrel is preferably double-walled, with the plurality of hammer drills disposed within the walls and positioned vertically so that the drill bits extend beyond the bottom end of the barrel. A pressurized air source is coupled to the core barrel at its top end. A manifold arrangement conducts air from the air source to conduits within the walls of the core barrel, which in turn deliver pressurized air to each hammer drill.

The core barrel has a diameter suitable for drilling foundation piles for buildings, bridges and the like. The diameter of the core barrel is typically 36–48 inches, although diameters of 72 inches or more may be realized. In practice, the diameter will be at least about 18 inches to produce piles suitable for use in foundations and related systems.

In operation, the core barrel is rotated by a top drive rotary or kelly bar on a conventional drilling rig. The core barrel has an opening at its top end for admitting a drilling fluid, or slurry, delivered thereto via a conduit connected to a swivel means located above the top drive rotary. As the core barrel is rotated to cut an annular kerf, the slurry is pumped downward between the double walls of the core barrel, toward the hammer drill bits. The slurry flows across the bit faces, simultaneously cooling the bits and washing the bottom of the kerf of particles dislodged by the bits. The slurry, laden with cuttings, then exits the kerf upward between the outside diameter of the core barrel and the excavated wall of the shaft, as well as between the inside diameter of the core barrel and the rock core.

Air from the pressurized air source is also exhausted from the shaft, carrying cuttings out of the kerf. Like the slurry, air is exhausted upward between the outside diameter of the core barrel and the excavated wall of the shaft. The top of the core barrel is provided with a plurality of vents to allow slurry and exhausted air to escape from the interior of the core barrel, thereby preventing excessive pressure build-up under the core barrel, which could otherwise impede drilling progress or even drive the core barrel upward out of the shaft. Exhaustion of the pressurized air is also accomplished by a plurality of conduits placed between the walls of the core barrel and extending its entire length to openings in the top surface of the core barrel.

Once the kerf is drilled to the desired depth, the core barrel is withdrawn from the kerf, and the core may be removed by any conventional technique. The resultant excavation may be cleaned, and then filled with cementitious material (such as concrete) and reinforcing steel to complete the pile. Alternatively, the core may be left in place to form the interior portion of a structural pile. In such a construction, the drilled annular kerf is filled with cementitious material, or a combination of cementitious material and reinforcing steel. Alternatively, a full-length metallic casing, such as steel, may be placed in the annular kerf. If necessary, the resulting annular spaces on both sides of the shell casing may then be grouted with cementitious material, sand or the like.

A hammer-type core barrel according to the present invention does not require excessive downward pressure to cut the kerf, unlike many conventional core barrels. In addition, it has numerous advantages over large-diameter gang drills. Since only a relatively narrow kerf is cut, rather than the entire interior of the shaft, drilling proceeds much more rapidly. Smaller and lighter hammer drills can be used, with attendant lower weight and cost, lesser requirements for air and fuel, and increased ease of handling and serviceability. Drilling noise may be substantially reduced, as well as pollution from airborne dust and earthen particles which are flushed from the shaft.

BRIEF DESCRIPTION OF THE DRAWINGS

The present invention is more easily understood with reference to the drawings, in which.

DETAILED DESCRIPTION OF THE PREFERRED EMBODIMENT

Figure 1:
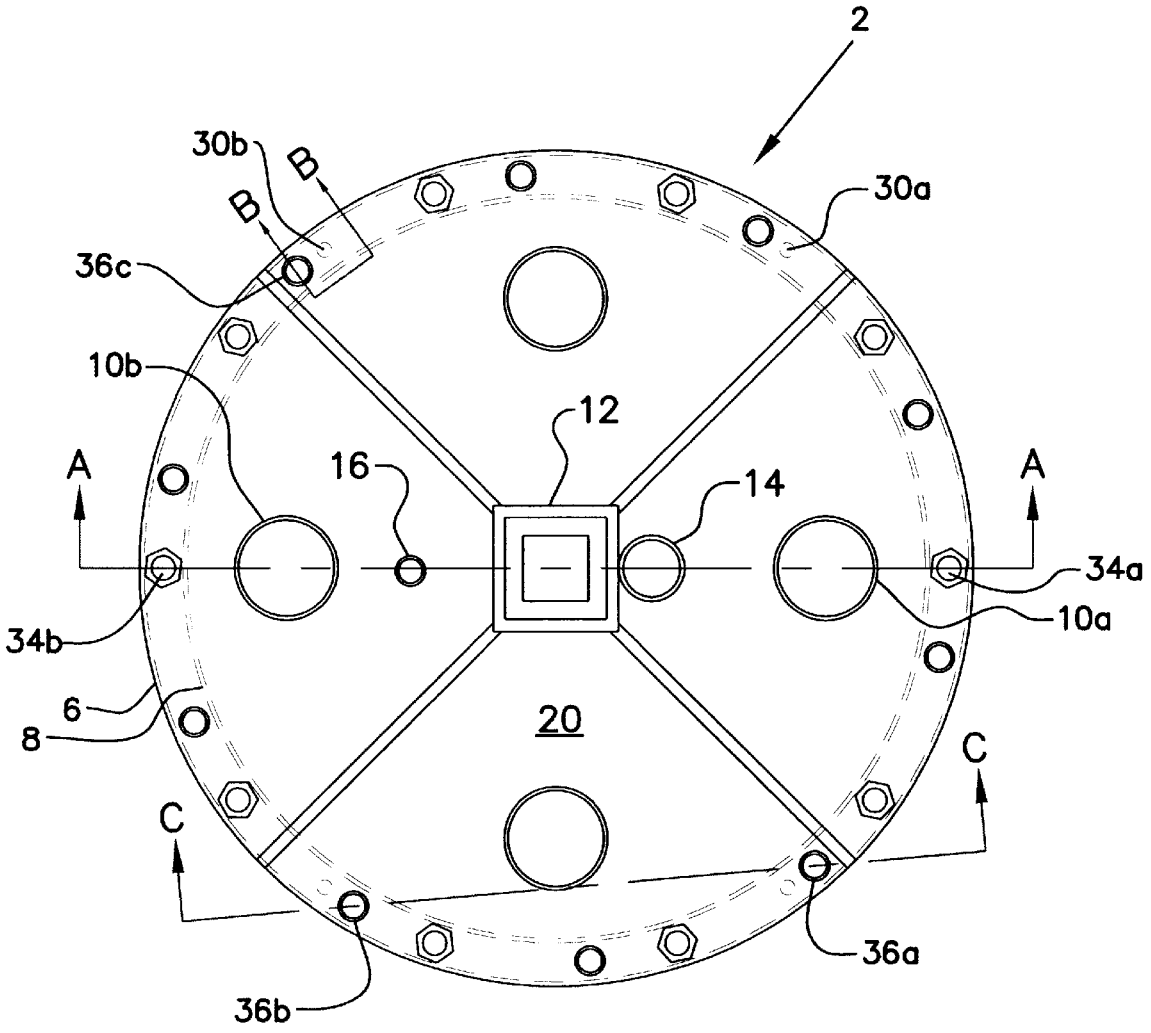
FIG. 1 is a top plan view of a core barrel according to the present invention.
Figure 2:
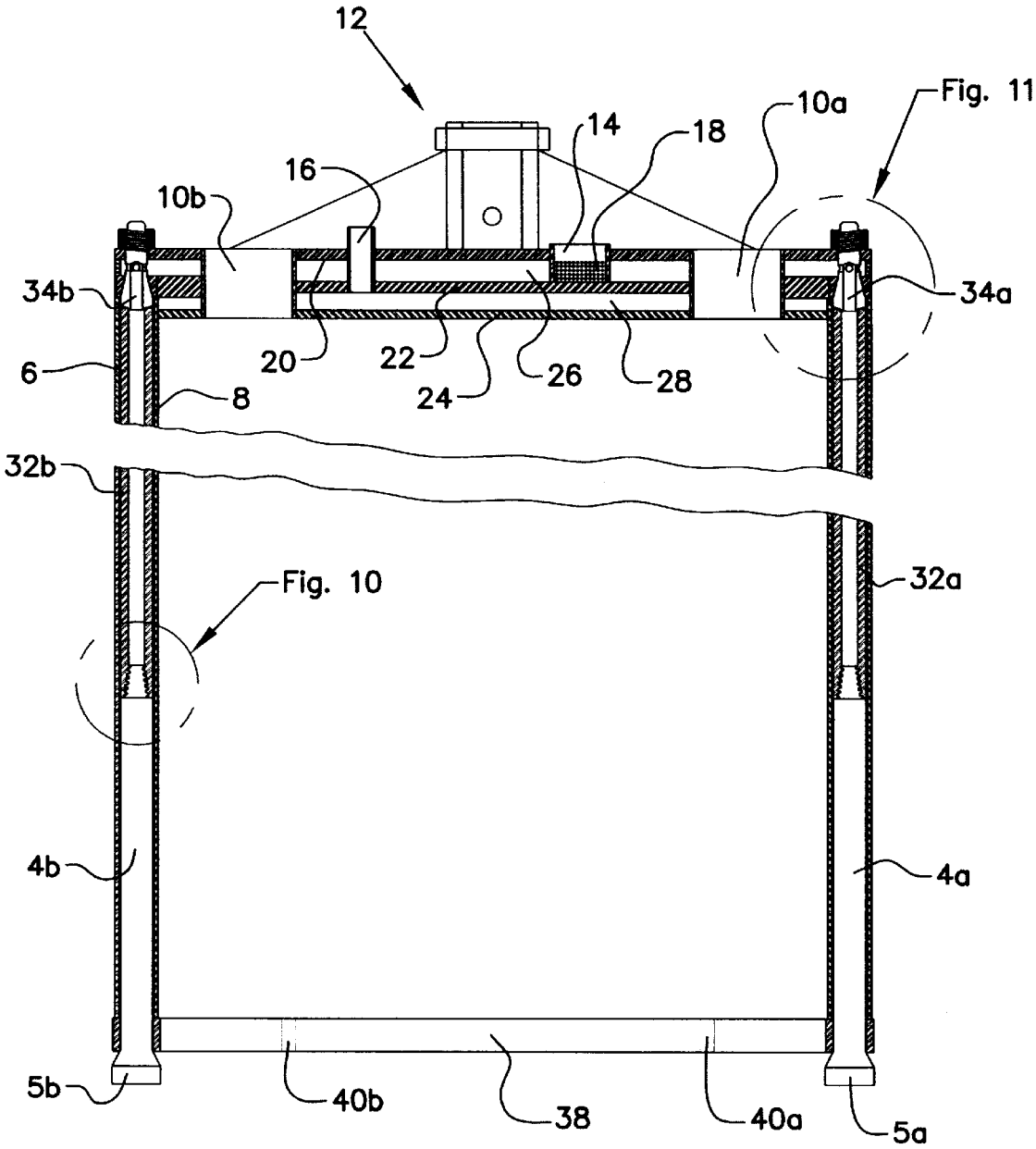
FIG. 2 is a cross-sectional view of a hammer-type core barrel taken along section A—A of FIG. 1, particularly showing the hammer drills and air and slurry paths.

There is shown in FIGS. 1 and 2 a core barrel 2 for drilling an annular kerf in the ground. For foundation drilling, the core barrel preferably has an outer diameter which is at least about 18 inches, but will typically be in the range of 24 inches to 48 inches, depending on the particular requirements of the foundation system which is to be constructed. For very large foundation systems the diameter may be 72 inches or more. Core barrel 2 has a length which will likewise depend on numerous factors, including the depth requirements of the foundation system to be constructed. It will be understood that lengths of 15 feet, 25 feet or more will not be uncommon.

Core barrel 2 is preferably of the double-walled type, including an outer wall 6 and an inner wall 8 defined by concentric cylinders having diameters and thicknesses selected to snugly accommodate a plurality of hammer drills 4*a,* 4*b* disposed in spaced relation proximate the perimeter of the core barrel between the walls. The core barrel walls are of sufficient thickness to withstand the particular drilling environment. For foundation drilling, a pipe having a 69.5 inch outer diameter and 68.75 inch inner diameter has proved suitable for use with a pipe having a 62.25 inch outer diameter and 61.5 inch inner diameter to form the outer wall 6 and inner wall 8 of the core barrel, respectively. Inner wall 8 defines a hollow interior of core barrel 2 for accommodating a core to be drilled. In the embodiment shown in FIG. 1, ten hammer drills 4*a,* 4*b* are spaced equally around the perimeter of the core barrel in the 3.25 inch gap between the outer and inner walls. The particular dimensions chosen for any application may depend on several factors, including the material to be excavated, the depth to be excavated, and the wall thickness of any casement or pipe which is desired to be placed in the kerf after drilling.

Hammer drills 4*a,* 4*b* may be any of a variety of conventional relatively smaller diameter pneumatic hammer drills available from numerous sources. An example is the Halco Mach 303 downhole hammer drill. Each hammer drill 4*a,* 4*b* includes a working end 5*a,* 5*b* including a drill bit portion which is periodically driven downward by a piston within the hammer drill that is actuated by pressurized air. Conventionally, the working ends 5*a,* 5*b* are provided with numerous tungsten carbide buttons which break up rock material during impact. Each hammer drill is retained firmly in place with respect to the core barrel by retaining ring 38, including a chuck and key arrangement discussed below with respect to FIGS. 12–15. The working ends 5*a,* 5*b* extend beyond the core barrel walls and retaining ring 38 and are of sufficient diameter to cut a swath which is wider than the space defined by outer wall 6 and inner wall 8 so that the core barrel may proceed into the kerf relatively unimpeded as drilling advances.

Referring to FIG. 2, core barrel 2 is provided with a drive mechanism 12, suitable for use with conventional foundation drilling rigs, such as a rotating kelly bar or top drive rotary. Pressurized air from an air source (not shown) is delivered to the hammer drills 4*a,* 4*b* as will now be described. The top of core barrel 2 is preferably provided with three generally parallel plates forming a top of the core barrel, which plates collectively define an air manifold and a slurry manifold for delivering pressurized air and a drilling slurry from external sources to the working end of the core barrel. Upper plate 20 defines the top exterior surface of core barrel 2 and accommodates both an air port 14 for receiving pressurized air and a slurry port 16 for receiving a drilling slurry, such as bentonite, ordinary water, polymer water, or other suitable solution. Middle plate 22 also accommodates slurry port 16 and defines, with upper plate 20, an air channel or manifold 26 in fluid communication with the external pressurized air source through air port 14. Air port 14 preferably includes a screen 18 to prevent foreign objects from entering air channel 26. The threat of such contamination of air channel 26 exists when, for example, core barrel 2 is worked in harsh environments, such as underwater conditions where the air supply might become disconnected from air port 14.

Pressurized air is delivered to hammer drills 4*a,* 4*b* via respective hammer air conduits 32*a,* 32*b,* which are coupled to air channel 26 by a plurality of air conduit connectors 34*a,* 34*b.* This pressurized air drives the hammer drills and, upon exiting the hammer drills, is exhausted from the kerf in various ways. Some of the air will be exhausted up and out of the kerf between the exterior of outer wall 6 the side of the shaft being drilled. Air will also attempt to exit the kerf upward between the core and the inner wall 8 of core barrel 2. Because of the large air volumes and pressures involved, this air can potentially exert so much upward pressure against the core barrel top as to overcome the effects of gravity and the downward pressure exerted on core barrel 2 by the drilling rig, preventing further drilling. In extreme circumstances, this pressure can be so great as to cause the core barrel to rise up, or even be ejected out of the kerf. Accordingly, there are preferably provided a plurality of relatively large vents 10*a,* 10*b* placing the hollow interior of the core barrel in fluid communication with the atmosphere.

Cuttings produced from the working ends 5*a,* 5*b* of hammer drills 4*a,* 4*b* are carried out of the kerf by air which is exhausted both through vents 10*a,* 10*b* and upward past the exterior of the core barrel. When drilling in moist ground or other similar conditions, the annular spaces in the kerf on either side of the core barrel walls may become clogged with cuttings and other detritus. Therefore, it is preferable to further provide a plurality of hollow flushing air conduits 36*a,* 36*b* disposed around the perimeter of the core barrel and extending the length of the core barrel, through retaining ring 38 at the working end of the core barrel and through upper plate 20, the top surface of core barrel 2. Such flushing conduits are less likely to become clogged than the annular spaces on either side of the core barrel's rotating walls, and are particularly helpful in exhausting larger cuttings, which may be too large to be ejected through the interior or exterior of the core barrel.

Figure 4:
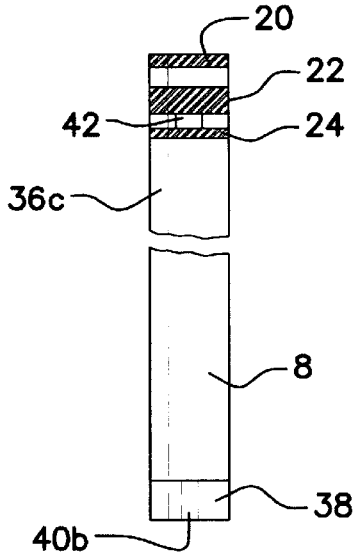
FIG. 4 is a cross-sectional view of a hammer-type core barrel taken along section B—B of FIG. 1.

As described briefly above, drilling may be further aided by the provision of a drilling slurry to wash and cool the drill bits and assist in carrying cuttings out of the kerf. Slurry port 16 in FIG. 2 receives slurry from an external source and transmits the slurry past air channel 26 to a slurry channel, or manifold, defined by middle plate 22 and lower plate 24. FIG. 4 is a cross-section of the core barrel showing an inside view of inner wall 8, in which is provided a plurality of slurry windows 42 for admitting the slurry from slurry channel 28 into the annular space between outer wall 6 and inner wall 8. The slurry flows freely downward toward retaining ring 38, in which is provided a plurality of slurry apertures 40*a,* 40*b* for permitting the slurry to pass out of core barrel 2 and into the kerf. Under pressure, the slurry passes across the face of drill bits at the working ends 5*a,* 5*b* of the hammer drills 4*a,* 4*b,* thereby to wash and cool the drill bits. The slurry, laded with cuttings, exits the kerf in a manner similar to the pressurized air.

Figure 3:
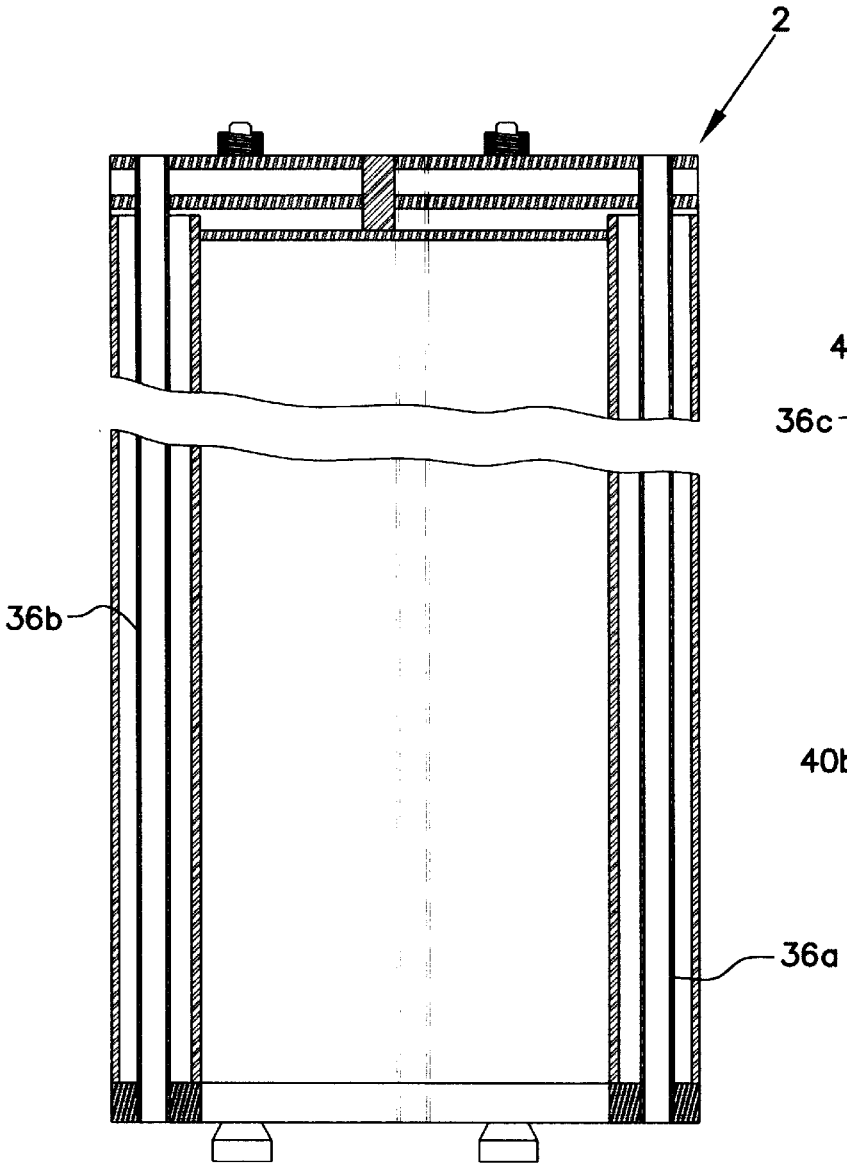
FIG. 3 is a cross-sectional view of a hammer-type core barrel taken along section C—C of FIG. 1, particularly showing air conduits useful for flushing cuttings from the kerf.

Structural details of the hammer-type core barrel are shown in FIGS. 3 and 4. Taken along section C—C of FIG. 1, a view of the placement of flushing air conduits 36*a* and 36*b* is provided in FIG. 3. FIG. 4 is taken along section B—B of FIG. 1, and particularly shows slurry window 42 formed through inner wall 8, and slurry exit aperture 40*b* formed through retaining ring 38. Also shown are flushing air conduit 36*c* (hidden), and upper plate 20, middle plate 22, and lower plate 24.

Figure 6:
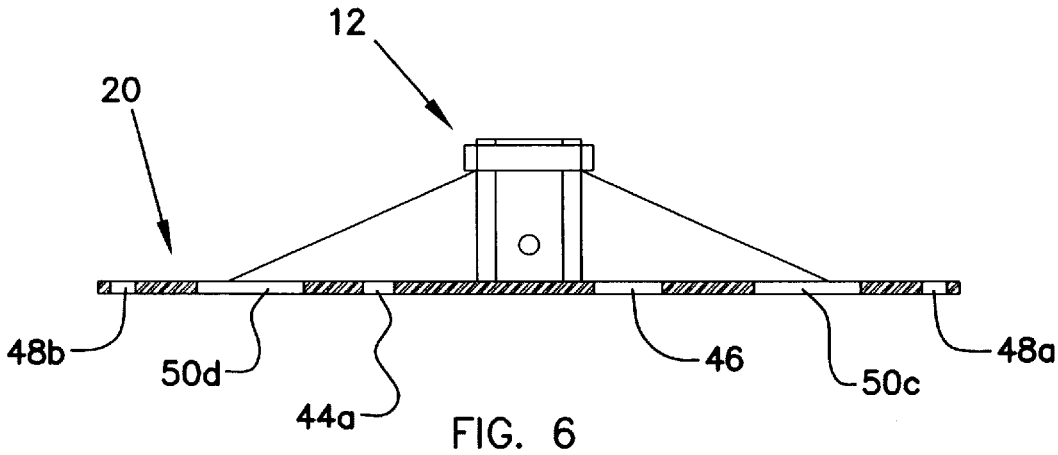
FIG. 6 is a cross-sectional view of the upper plate taken along section D—D of FIG. 5.
Figure 5:
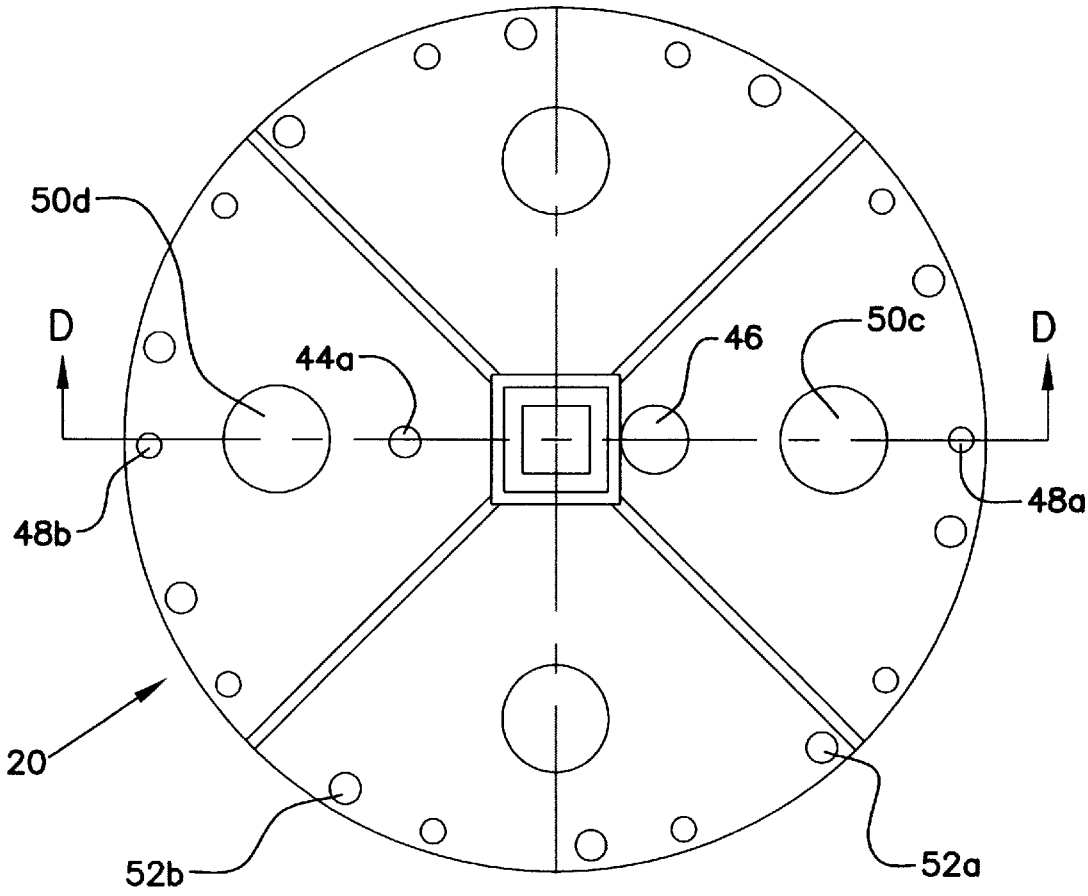
FIG. 5 is a top plan view of an upper plate forming part of the core barrel top.

Upper plate 20 is depicted in FIGS. 5 and 6, where FIG. 6 is taken along section D—D of FIG. 5. There are provided a plurality of vent apertures 50*c,* 50*d* for receiving vents 10*a,* 10*b.* Also provided are slurry port aperture 44*a* and air port aperture 46 for receiving slurry port 16 and air port 14, respectively. Air conduit connector apertures 48*a,* 48*b* receive air conduit connectors 34*a* and 34*b* for fastening, as shown more particularly in FIG. 11.

Figure 8:
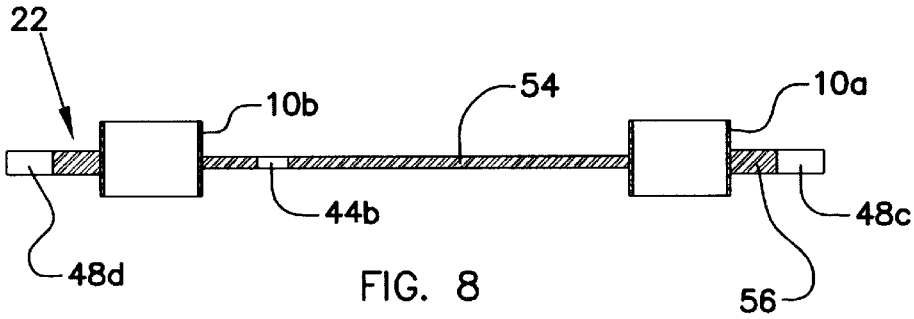
FIG. 8 is a cross-sectional view of the middle plate taken along section E—E of FIG. 7.
Figure 7:
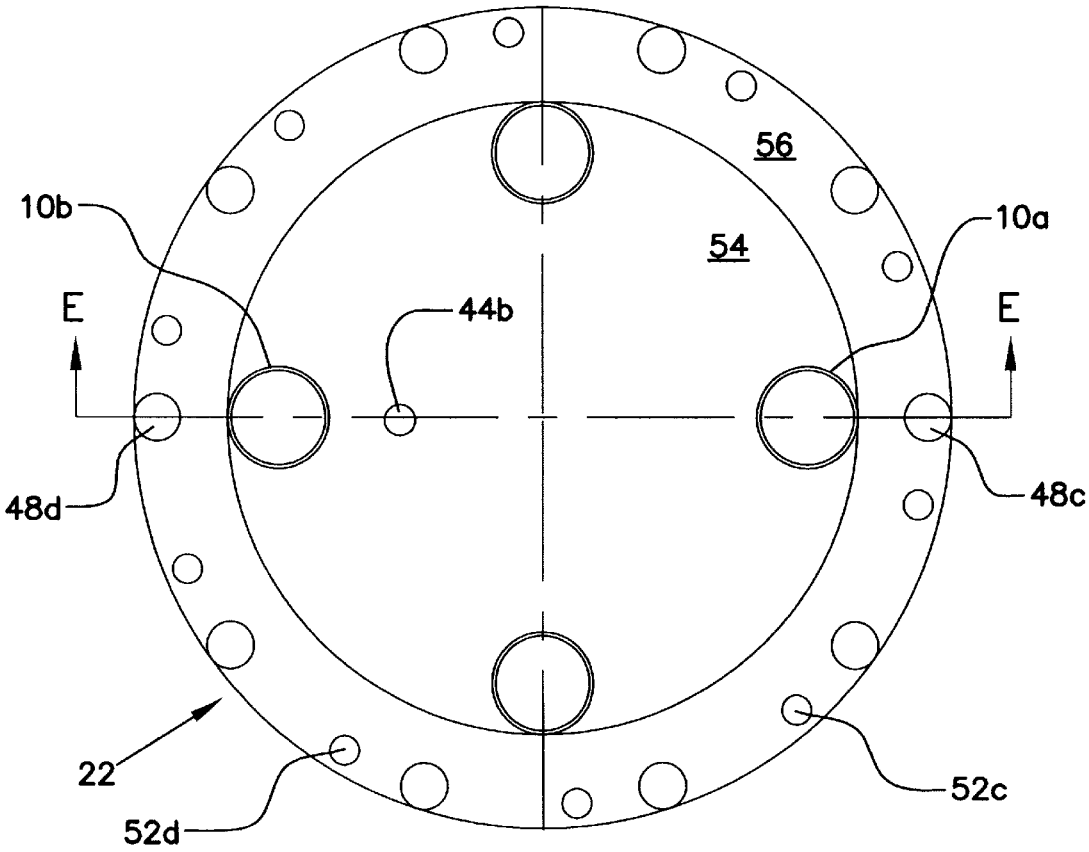
FIG. 7 is a top plan view of a middle plate forming part of the core barrel top and defining an air channel on one side thereof and a slurry channel on the other side thereof.

Middle plate 22 is depicted in FIGS. 7 and 8, where FIG. 8 is taken along section E—E of FIG. 7. Vents 10*a,* 10*b* are preferably sections of pipe and are fixedly mounted in middle plate 22, such as by welding. Middle plate 22 has an inner portion 54 and an outer portion 56, which may have thickness of one inch and two inches, respectively. Also provided are slurry port aperture 44*b,* air conduit connector apertures 48*c,* 48*d,* and flushing air conduit apertures 52*c,* 52*d.*

Figure 9:
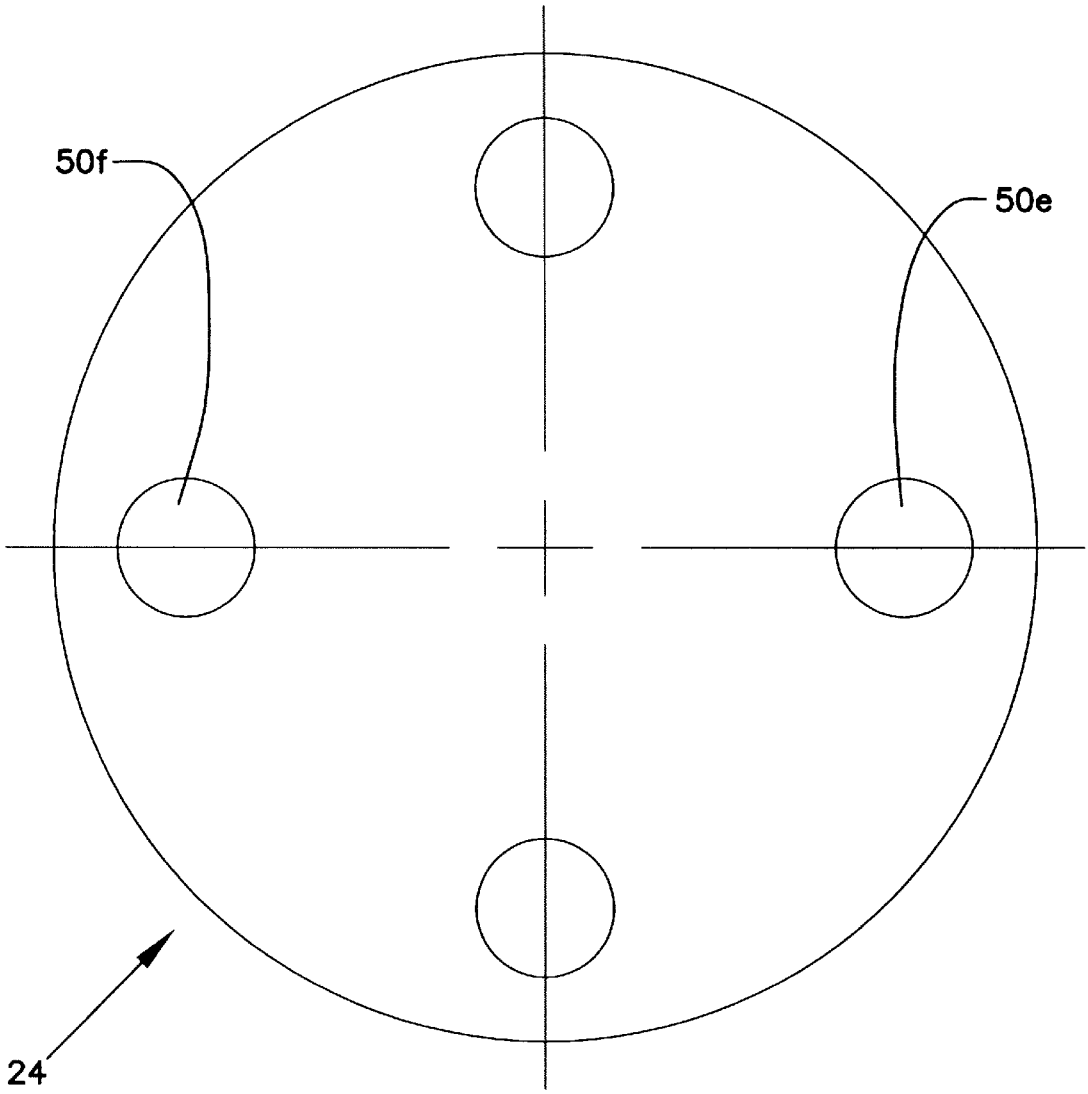
FIG. 9 is a top plan view of a lower plate forming part of the core barrel top and defining a slurry channel on one side thereof and a portion of the interior of the core barrel on the other side thereof.

Lower plate 24 is depicted in FIG. 9, whose upper surface defines a portion of slurry channel 28. Lower plate 24 is provided with a plurality of vent apertures 50*e,* 50*f* for receiving vents 10*a,* 10*b.*

Figure 10:
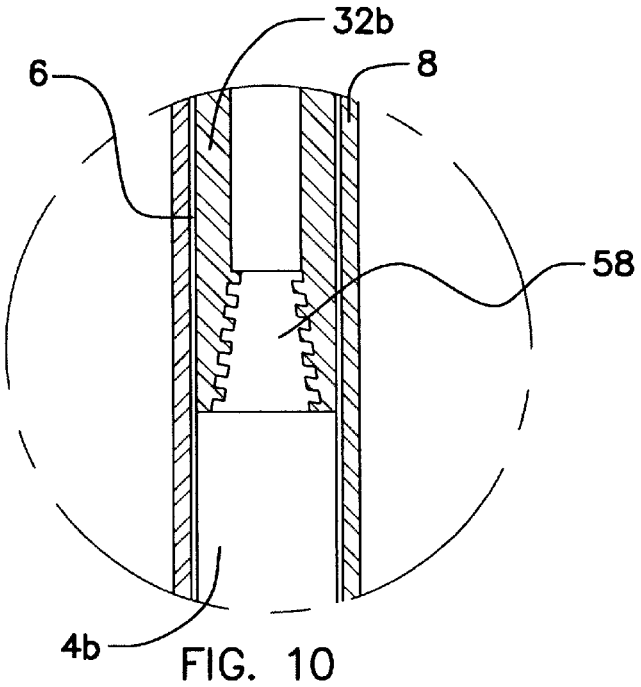
FIG. 10 is an enlarged view of a portion of FIG. 2 showing the coupling of an air conduit to a hammer drill.

The connection between an air conduit and a hammer drill in the double-walled core barrel is shown in the expanded side view of FIG. 10. Hammer drill 4*b* is retained within outer wall 6 and inner wall 8 of core barrel 2. Hammer drill 4*b* is provided with hammer drill air connector 58, which is coupled to hammer air conduit 32*b.*

Figure 11:
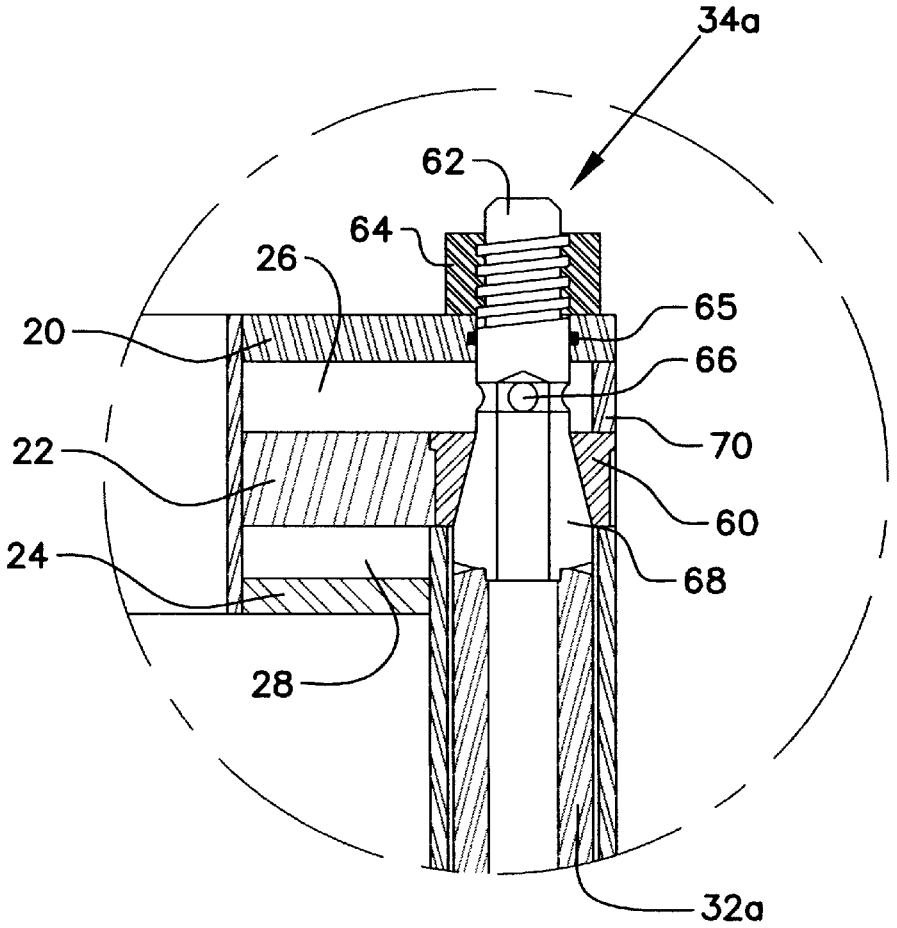
FIG. 11 is an enlarged view of a portion of FIG. 3 showing the coupling of the air channel in the top of the core barrel to an air conduit for a hammer drill.
Figure 12:
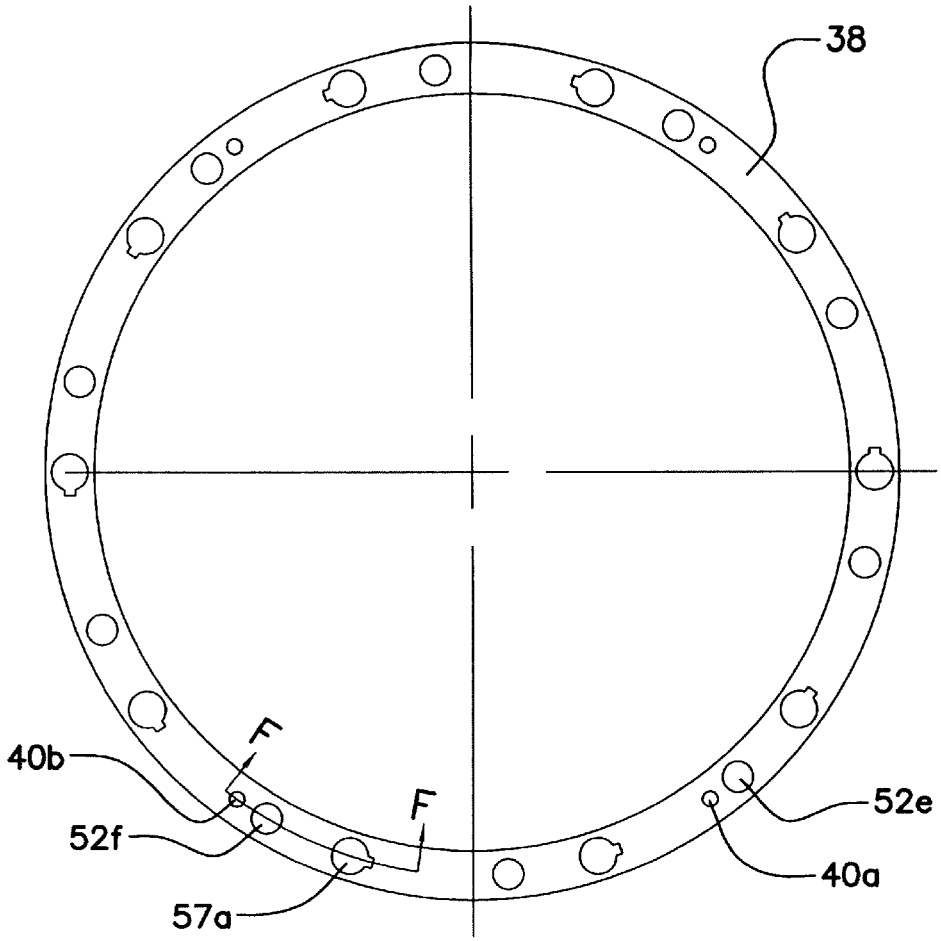
FIG. 12 is a plan view of a retaining ring adjoining the inner and outer walls of the core barrel at its working end.

FIG. 11 shows the coupling of the air channel at the top of the core barrel to an air conduit within the double-walled core barrel. Middle plate 22 defines slurry channel 28 with lower plate 24, and it defines air channel 26 with upper plate 20 as described above. Sealing ring 70 completes the enclosure defining air channel 26. An air conduit connector 34*a* provides the fluid coupling between air channel 26 and hammer air conduit 32*a*. Conical portion 68 of connector 34*a* engages air conduit 32*a* at its lower end and is provided with a plurality of air orifices 66 at the level of air channel 26. Air channel 26 is made substantially airtight by bushing 60, which engages conical section 68 tightly. Connector 34*a* is drawn upward by the engagement of threaded portion 62 with nut 64, thereby enhancing the seal between conical section 68 and bushing 60. Air connector 34*a* is made airtight with upper plate 20 using O-ring 65 disposed in a groove machined in upper plate 20.

Figure 13:
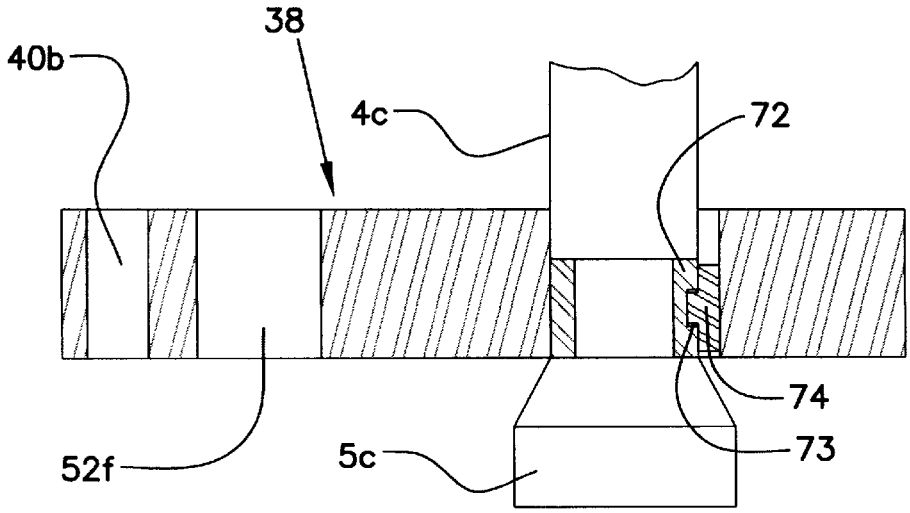
FIG. 13 is a cross-sectional view of the retaining ring of FIG. 12 taken along section F—F with a hammer drill retained therein.

FIG. 13 shows one embodiment of retaining ring 38, which is preferably affixed to the lower ends of outer wall 6 and inner wall 8, such as by welding. Drilling slurry exits from between the core barrel walls through a plurality of slurry exit apertures 40*a*, 40*b*. Cuttings from the kerf are vented upward through a plurality of flushing air conduits inserted in flushing air conduit apertures 52*e*, 52*f*. Each hammer drill disposed within the core barrel is fitted through a notched, circular hammer drill receptacle 57*a*. The means for securing a hammer drill 4*c* within receptacle 57*a* is shown in FIG. 13, which is a cross-sectional view taken along section F—F of FIG. 12. Hammer drill 4*c* has a working end 5*c* including a bit face, which extends through retaining ring 38. Circular chuck 72, which is preferably constructed of metal, secures hammer drill 4*c* against lateral movement within receptacle 57 *a*. Key 74 is fastened to circular chuck 72 such as by weldment 73, thereby preventing rotation of hammer drill 4*c* within receptacle 57*a*. Chuck 72 is preferably provided without splines which would otherwise prevent rotation of the bits within the hammer drill. Allowing the bits to rotate during drilling ensures that there will be no protruding tungsten carbide buttons nearest the outer diameter of core barrel 2 that will receive excessive wear.

Figure 14:
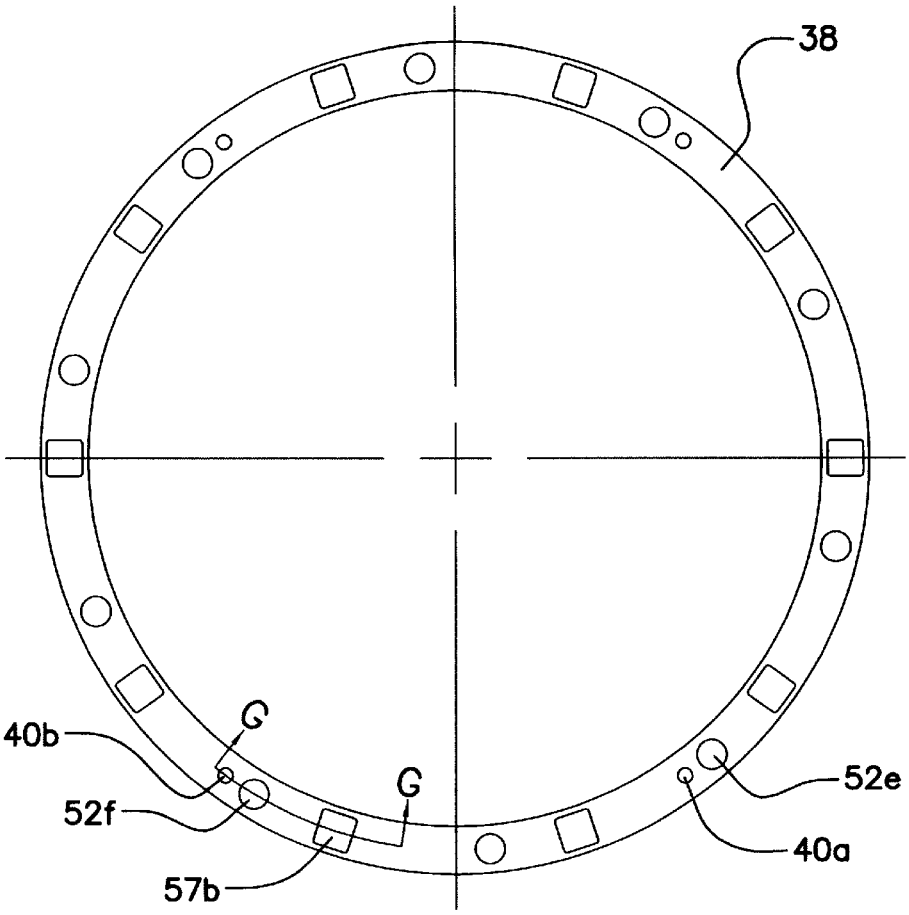
FIG. 14 is an alternative embodiment of the retaining ring of FIG. 12.
Figure 15:
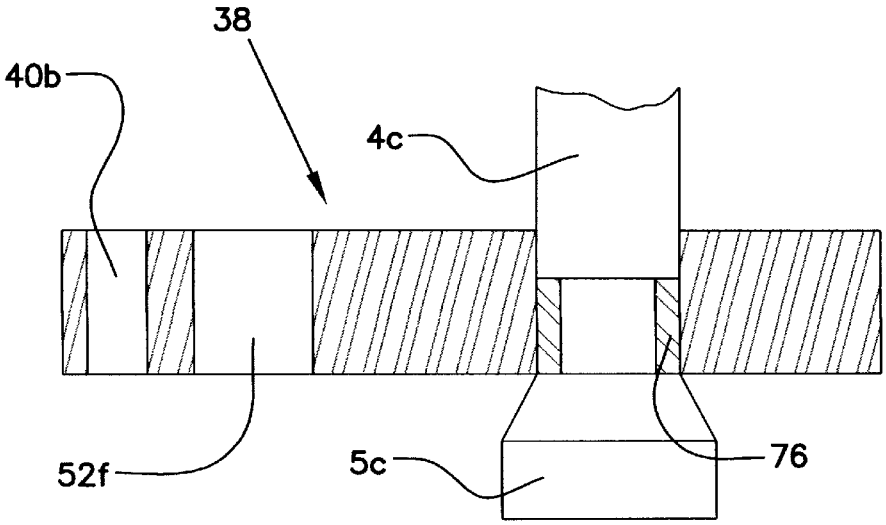
FIG. 15 is a cross-sectional view of the retaining ring of FIG. 14 taken along section G—G with a hammer drill retained therein.

In an alternative embodiment shown in FIGS. 14 and 15, retaining ring 38 has a substantially square hammer drill receptacle 57*b*. Such a configuration permits the use of a substantially square chuck 76, eliminating the need for a key to prevent rotation of the chuck and hammer drill 4*c* in receptacle 57*b*. Other suitable shapes for the chuck and receptacle may be employed so long as the arrangement prevents turning of the hammer drill chuck induced by rotation of core barrel 2 in the kerf during drilling.

Figure 16:
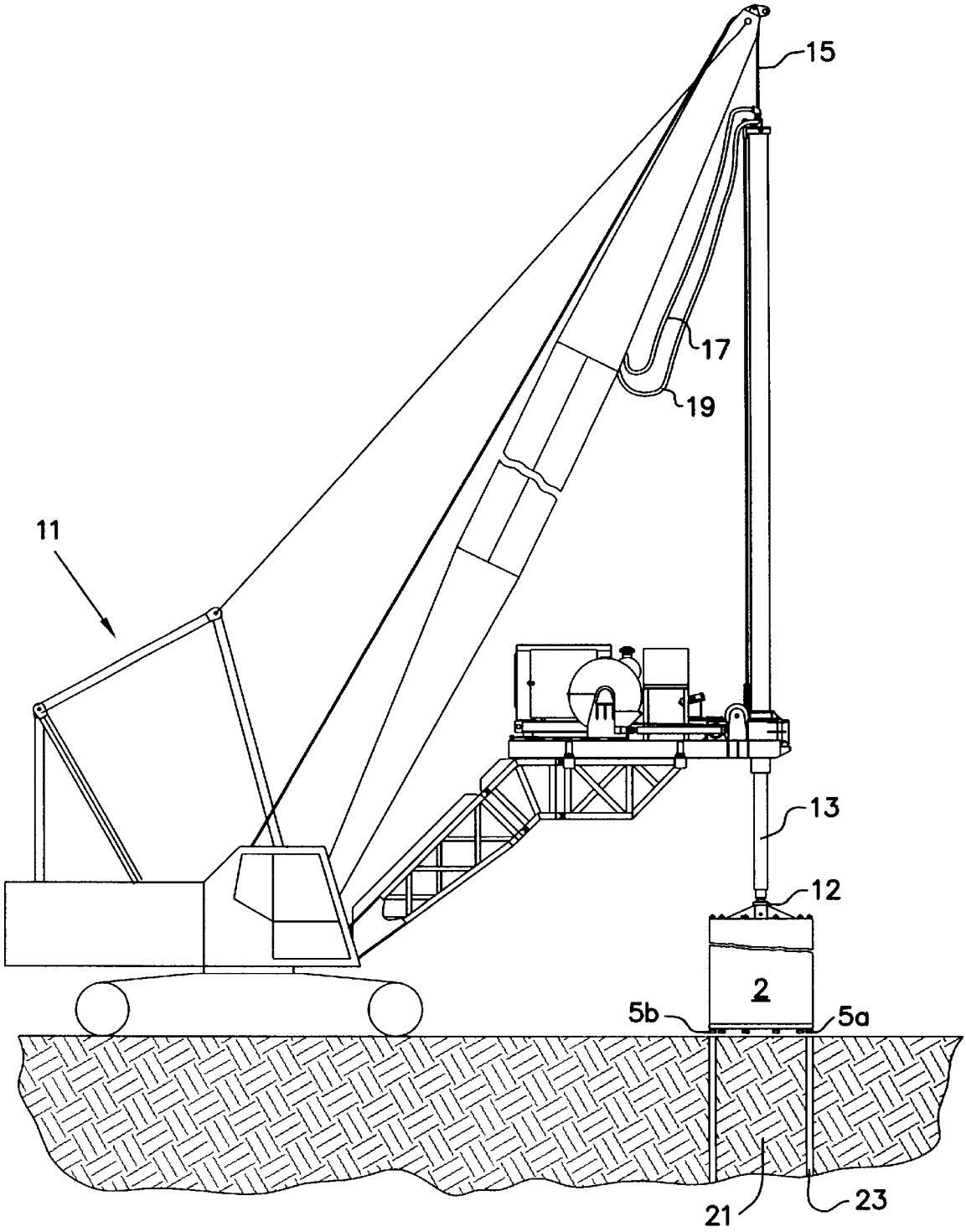
FIG. 16 is a side view of a hammer-type core barrel suspended in operation from a conventional drilling rig for drilling an annular kerf in the ground.
Figure 17:
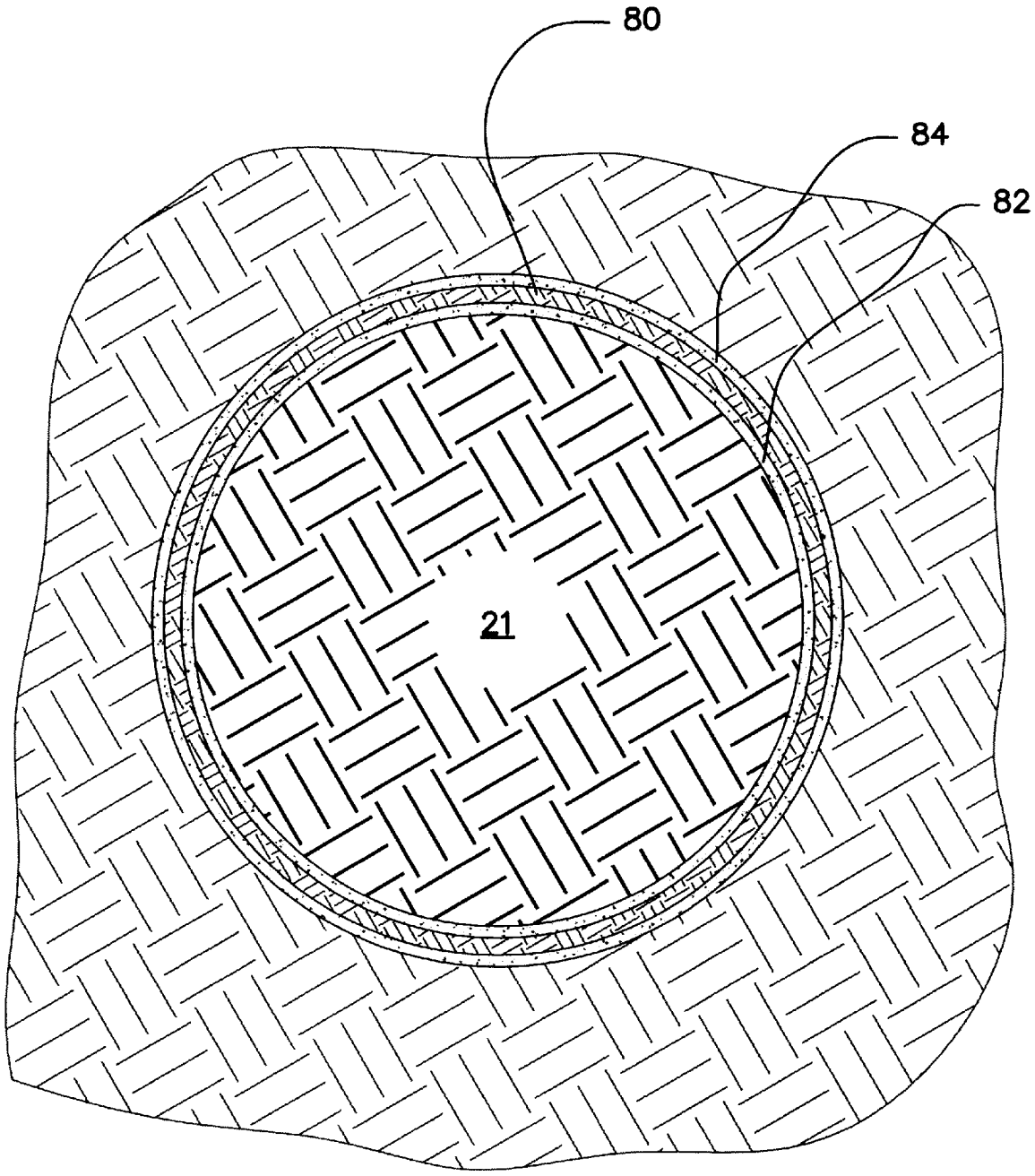
FIG. 17 is a top plan view of a pile constructed using a hammer-type core barrel and formed of full-length, structural steel casing surrounding an earthen core.

Construction of a foundation pile with the foregoing hammer-type core barrel is now described, with particular reference to FIGS. 16–17. Core barrel 2 is suspended from drilling rig 11, which may be a crane or excavator-type crawler, or other similar type of machinery. Core barrel 2 is preferably driven by a hollow kelly bar 13 suspended from hoist cable 15. Slurry hose 17 delivers drilling slurry to a feed mechanism on top of kelly bar 13 and then via a hose or other suitable conduit to slurry port 16 (FIG. 2) on the core barrel. Similarly, air hose 19 delivers air from a high-pressure source to air port 14 atop core barrel 2 (FIG. 2). Such an arrangement enables the top of core barrel 2 to be lowered deep below the ground surface. Alternatively, the drilling slurry may be introduced into the core barrel via a fluid swivel atop the core barrel.

As illustrated in FIG. 2, core barrel 2 is provided at its working end with a plurality of hammer drills 4*a*, 4*b* of the type previously described. When drilling commences, core barrel 2 is rotated and lowered to the ground via kelly bar 13, thus to begin drilling annular kerf 23 around rock core 21. Drilling is preferably at speeds in the range of 5 to 6 revolutions per minute, but will usually be determined by a number of considerations, including diameter of the core barrel, the number of hammer drills used, and the characteristics of the ground to be drilled.

Particularly where the ground to be drilled is not level or smooth, it may be desired to use an embodiment of the hammer-type core barrel in which the hammer drills are not uniformly spaced around the core barrel's perimeter. When not in contact with the ground, hammer drills 4*a*, 4*b* release substantial amounts of pressurized air past the bits, resulting in the consumption of air to drive hammers that are not cutting. Therefore, it may be desired to concentrate the hammer drills in close spaced relation toward one side of core barrel 2 so that a greater number of hammer drills are in contact with the ground at a given time, thereby reducing the excessive release of air.

Referring again to FIGS. 16–17, drilling proceeds as core barrel 2 is lowered into kerf 23, thereby cutting around core 21. The working ends 5*a*, 5*b* of the hammer drills operate to cut kerf 23 by dislodging pieces of the ground on the bottom of the kerf through repeated cyclical impacts. Rotation of core barrel 2 advances the hammer drills to fresh ground on the bottom of kerf 23 so as to cut the kerf in a continuous fashion. Once the annular kerf 23 is drilled to the desired depth, core barrel 2 is preferably withdrawn, leaving core 21 behind. It is then possible to construct piles in the usual manner, wherein core 21 is removed, and this operation may be repeated to obtain successively deeper shaft depths. If it is desired to remove the core, the resulting excavation is filled by placing a cementitious material such as concrete into the kerf. Steel reinforcing bars may also be placed vertically in the excavation prior to filling with cementitious material.

Alternatively, core 21 remains in place after core barrel 2 is withdrawn from the kerf. A rigid foundation pile is then constructed by placing a suitable casing material in kerf 23. In one embodiment, reinforcing steel bars are placed longitudinally into kerf 23. The kerf is then filled by placing a cementitious material therein.

In the embodiment illustrated in FIG. 17, metallic casement 80 is placed in kerf 23 to form the exterior structural component of the pile. Metallic casement 80 is preferably steel and extends the entire depth of the kerf 23 and slightly thereabove to an elevation which allows the attachment of a building foundation thereto (i.e., has a length somewhat greater than the depth of the kerf). Casement 80 will typically have a thickness less than the thickness of annular kerf 23 to allow easier insertion of the casement. Under these circumstances an inner annulus 82 and outer annulus 84 remain after metallic casement 80 is inserted into the kerf. These annuluses may be grouted with cementitious material, sand or the like if desired. This construction provides a very strong structural pile. In addition, when non-cementitious material such as sand is used as the grout, such a foundation pile does not require that cement be mixed or transported to the construction site, thereby providing significant advantages over conventional concrete-based systems.

While a particular embodiment of the invention has been illustrated and described, it will be obvious to those skilled in the art that various changes and modifications may be made without sacrificing the advantages provided by the principles of construction and operation disclosed herein.

What is claimed is:

1. A core barrel having a working end for excavating ground in which substantially vertical foundation piles or secant wall piles are to be constructed, said core barrel comprising:

a drive mechanism proximate a top end of said core barrel and adapted to receive a rotating kelly bar or top drive rotary;

at least one core barrel wall defining a hollow interior of said core barrel and having a diameter of at least 36 inches;

a plurality of hammer drills disposed proximate the perimeter of said core barrel, each of said hammer drills having a working end extending past said core barrel wall sufficiently far to cut a kerf having a diameter greater than said top end of the core barrel;

a plurality of air conduits, each of said air conduits connected to one of said plurality of hammer drills for delivering pressurized air thereto.

2. The core barrel of claim 1, wherein said core barrel wall further comprises an inner wall and an outer wall, said plurality of hammer drills being disposed between said inner wall and said outer wall.

3. A core barrel having a working end for excavating ground in which foundation piles or secant wall piles are to be constructed, said core barrel comprising:

a drive mechanism proximate a top end of said core barrel and adapted to receive a rotating kelly bar or top drive rotary;

at least one core barrel wall defining a hollow interior of said core barrel and having a diameter of at least 18 inches;

a plurality of hammer drills disposed proximate the perimeter of said core barrel, each of said hammer drills having a working end extending past said core barrel wall;

a plurality of air conduits, each of said air conduits connected to one of said plurality of hammer drills for delivering pressurized air thereto;

a plurality of plates forming a top of the core barrel, at least two of said plates defining an air channel for delivering air to said plurality of air conduits.

4. The core barrel of claim 3, wherein at least one of said plurality of plates further comprises at least one vent for exhausting air from within the core barrel.

5. The core barrel of claim 3, wherein at least two of said plates define a slurry channel for delivering slurry to the plurality of hammer drills.

6. The core barrel of claim 3, wherein said core barrel wall further comprises an inner wall and an outer wall, said plurality of hammer drills being disposed between said inner wall and said outer wall.

7. The core barrel of claim 6, wherein at least two of said plates define a slurry channel for delivering slurry to the plurality of hammer drills.

8. The core barrel of claim 6, wherein at least one of said plurality of plates further comprises at least one vent for exhausting air from within the core barrel.

9. The core barrel of claim 8, further comprising means for retaining the plurality of hammer drills between said inner wall and said outer wall.

10. A core barrel having a proximal end and a working end for excavating ground, said core barrel comprising:

a drive mechanism coupled to said proximal end of the core barrel and adapted to receive a rotating kelly bar or top drive rotary;

at least one core barrel wall defining a hollow interior of said core barrel and having a diameter of between 36 and 72 inches;

a plurality of hammer drills disposed proximate the perimeter of said core barrel, each of said hammer drills having a working end extending past said core barrel wall sufficiently far to cut a kerf having a diameter greater than said proximal end of the core barrel;

a plurality of air conduits, each of said air conduits connected to one of said plurality of hammer drills for delivering pressurized air thereto.

* * * * *

US006189630C1

(12) EX PARTE REEXAMINATION CERTIFICATE (4869th)

United States Patent

Beck, III

(10) Number: US 6,189,630 C1

(45) Certificate Issued: Oct. 21, 2003

(54) DOWNHOLE HAMMER-TYPE CORE BARREL

(75) Inventor: August H. Beck, III, 10 Hearthwood, San Antonio, TX (US) 78248

(73) Assignee: August H. Beck, III, San Antonio, TX (US)

( * ) Notice: This patent issued on a continued prosecution application filed under 37 CFR 1.53(d), and is subject to the twenty year patent term provisions of 35 U.S.C. 154(a)(2).

Reexamination Request:
No. 90/006,294, May 17, 2002

Reexamination Certificate for:

| | |
|---|---|
| Patent No.: | **6,189,630** |
| Issued: | **Feb. 20, 2001** |
| Appl. No.: | **09/098,940** |
| Filed: | **Jun. 17, 1998** |

(51) Int. Cl.[7] ..... E21B 4/16

(52) U.S. Cl. ..... 175/96; 175/108; 175/405

(56) References Cited

U.S. PATENT DOCUMENTS

| | | | | |
|---|---|---|---|---|
| 2,016,068 A | * | 10/1935 | Bannister | 175/96 |
| 4,013,319 A | * | 3/1977 | Wise | 299/31 |
| 4,671,367 A | * | 6/1987 | Brunsing et al. | 175/58 |
| 4,697,649 A | * | 10/1987 | Kinnan | 175/19 |
| 4,729,439 A | * | 3/1988 | Kurt | 175/96 |
| 4,883,133 A | * | 11/1989 | Fletcher et al. | 175/93 |
| 5,174,390 A | | 12/1992 | Kurt | |

FOREIGN PATENT DOCUMENTS

| | | |
|---|---|---|
| JP | 2633215 | 4/1997 |

OTHER PUBLICATIONS

Informational Brochure on Keystone Drill Services Inc.*

Informational Brochure on The Hole Story—A Guide to Downhole Drills, Ingersoll–Rand Co., (Mar. 1997).*

Yokoyama Foundation Works, Ltd., Yokoyama RCD (Ring Cluster Drill) Construction Method with Target Excavation Depth of 200 m, Jan. 1996 (translation provided).

* cited by examiner

*Primary Examiner*—William P. Neuder

(57) ABSTRACT

A core barrel has a plurality of pneumatic downhole hammer drills disposed around the perimeter of its working end for drilling piles in the ground for use in foundations, secant piles, and the like. The core barrel includes a slurry port and an air port at its top end for admitting a drilling slurry and pressurized air, which is used in driving the hammer drills and flushing cuttings from an annular kerf during drilling. A plurality of generally parallel plates form the top of the core barrel and define an air channel and a slurry channel for delivering air and slurry to the core barrel wall, where they flow freely or via conduits toward the hammer drills at the working end of the core barrel. The hammer-type core barrel is used to construct piles by first drilling an annular kerf in the ground. Circulating drilling fluid cools the working end of the hammer drills elements and washes cuttings from the kerf during drilling. The drilled core may be removed, or it may remain in situ, with the kerf being filled by cementitious material or by a structural steel casement.

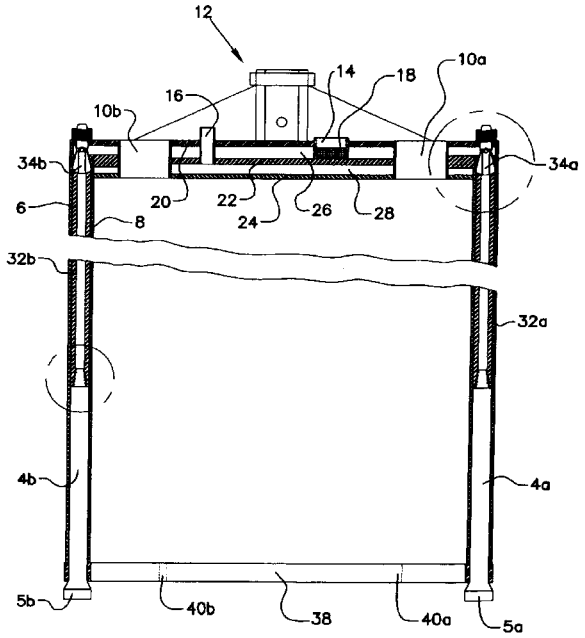

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–9 is confirmed.

Claims 1 and 10 are determined to be patentable as amended.

Claim 2, dependent on an amended claim, is determined to be patentable.

1. A core barrel having a working end for excavating ground in which substantially vertical foundation piles or secant wall piles are to be constructed, said core barrel comprising:

a drive mechanism proximate a top end of said core barrel and adapted to receive a rotating kelly bar or top drive rotary *for imparting rotation to the core barrel*;

at least one core barrel wall defining a hollow interior of said core barrel and having a diameter of at least 36 inches;

a plurality of hammer drills disposed proximate the perimeter of said core barrel, each of said hammer drills having a working end extending past said core barrel wall sufficiently far to cut a kerf having a diameter greater than said top end of the core barrel;

a plurality of air conduits, each of said air conduits connected to one of said plurality of hammer drills for delivering pressurized air thereto.

10. A core barrel having a proximal end and a working end for excavating ground, said core barrel comprising:

a drive mechanism coupled to said proximal end of the core barrel and adapted to receive a rotating kelly bar or top drive rotary *for imparting rotation to the core barrel*;

at least one core barrel wall defining a hollow interior of said core barrel and having a diameter of between 36 and 72 inches;

a plurality of hammer drills disposed proximate the perimeter of said core barrel, each of said hammer drills having a working end extending past said core barrel wall sufficiently far to cut a kerf having a diameter greater than said proximal end of the core barrel;

a plurality of air conduits, each of said air conduits connected to one of said plurality of hammer drills for delivering pressurized air thereto.

* * * * *